US007661765B2

(12) United States Patent
Hall et al.

(10) Patent No.: US 7,661,765 B2
(45) Date of Patent: Feb. 16, 2010

(54) BRAZE THICKNESS CONTROL

(76) Inventors: David R. Hall, 2185 S. Larsen Pkwy., Provo, UT (US) 84606; Jacob Smith, 2185 S. Larsen Pkwy., Provo, UT (US) 84606

( * ) Notice: Subject to any disclaimer, the term of this patent is extended or adjusted under 35 U.S.C. 154(b) by 0 days.

(21) Appl. No.: 12/200,810

(22) Filed: Aug. 28, 2008

(65) Prior Publication Data

US 2008/0315667 A1 Dec. 25, 2008

Related U.S. Application Data

(63) Continuation of application No. 12/200,786, filed on Aug. 28, 2008, which is a continuation-in-part of application No. 12/177,556, filed on Jul. 22, 2008, now Pat. No. 7,635,168, which is a continuation-in-part of application No. 12/135,595, filed on Jun. 9, 2008, which is a continuation-in-part of application No. 12/112,743, filed on Apr. 30, 2008, which is a continuation-in-part of application No. 12/051,738, filed on Mar. 19, 2008, which is a continuation-in-part of application No. 12/051,689, filed on Mar. 19, 2008, which is a continuation of application No. 12/051,586, filed on Mar. 19, 2008, which is a continuation-in-part of application No. 12/021,051, filed on Jan. 28, 2008, which is a continuation-in-part of application No. 12/021,019, filed on Jan. 28, 2008, which is a continuation-in-part of application No. 11/971,965, filed on Jan. 10, 2008, now Pat. No. 7,648,210, which is a continuation of application No. 11/947,644, filed on Nov. 29, 2007, which is a continuation-in-part of application No. 11/844,586, filed on Aug. 24, 2007, now Pat. No. 7,600,823, which is a continuation-in-part of application No. 11/829,761, filed on Jul. 27, 2007, which is a continuation-in-part of application No. 11/773,271, filed on Jul. 3, 2007, which is a continuation-in-part of application No. 11/766,903, filed on Jun. 22, 2007, which is a continuation of application No. 11/766,865, filed on Jun. 22, 2007, which is a continuation-in-part of application No. 11/742,304, filed on Apr. 30, 2007, now Pat. No. 7,475,948, which is a continuation of application No. 11/742,261, filed on Apr. 30, 2007, now Pat. No. 7,469,971, which is a continuation-in-part of application No. 11/464,008, filed on Aug. 11, (Continued)

(51) Int. Cl.
*E21C 35/18* (2006.01)

(52) U.S. Cl. ..... 299/113; 299/111

(58) Field of Classification Search ..... 299/105, 299/106, 111, 113
See application file for complete search history.

(56) References Cited

U.S. PATENT DOCUMENTS 2,004,315 A 6/1935 Fean (Continued)

*Primary Examiner*—John Kreck
(74) *Attorney, Agent, or Firm*—Tyson J. Wilde

(57) ABSTRACT

In one aspect of the present invention, a degradation assembly comprises an inverted conical face formed in a top end of a metal body tapering towards a central axis of the metal body. A base end of a carbide bolster is adapted to be brazed to the top end of the metal body within the inverted conical face. At least one protrusion is formed in the inverted conical face and is adapted to control a braze thickness between the face and the base end.

14 Claims, 12 Drawing Sheets

Related U.S. Application Data

2006, now Pat. No. 7,338,135, which is a continuation-in-part of application No. 11/463,998, filed on Aug. 11, 2006, now Pat. No. 7,384,105, which is a continuation-in-part of application No. 11/463,990, filed on Aug. 11, 2006, now Pat. No. 7,320,505, which is a continuation-in-part of application No. 11/463,975, filed on Aug. 11, 2006, now Pat. No. 7,445,294, which is a continuation-in-part of application No. 11/463,962, filed on Aug. 11, 2006, now Pat. No. 7,413,256, which is a continuation-in-part of application No. 11/463,953, filed on Aug. 11, 2006, now Pat. No. 7,464,993, application No. 12/200,810, which is a continuation-in-part of application No. 11/695,672, filed on Apr. 3, 2007, now Pat. No. 7,396,086, which is a continuation-in-part of application No. 11/686,831, filed on Mar. 15, 2007, now Pat. No. 7,568,770.

(56) References Cited

U.S. PATENT DOCUMENTS

| | | | | |
|---|---|---|---|---|
| 2,124,438 | A | 7/1938 | Struk | |
| 3,254,392 | A | 6/1966 | Novkov | |
| 3,342,531 | A * | 9/1967 | Krekeler | 299/107 |
| 3,745,396 | A | 7/1973 | Radd | |
| 3,807,804 | A | 4/1974 | Kniff | |
| 3,830,321 | A | 8/1974 | McKenzy | |
| 3,932,952 | A | 1/1976 | Helton | |
| 3,945,681 | A | 3/1976 | White | |
| 4,005,914 | A | 2/1977 | Newman | |
| 4,006,936 | A | 2/1977 | Crabiel | |
| 4,098,362 | A | 7/1978 | Bonnice | |
| 4,109,737 | A | 8/1978 | Bovenkerk | |
| 4,156,329 | A | 5/1979 | Daniels | |
| 4,199,035 | A | 4/1980 | Thompson | |
| 4,201,421 | A | 5/1980 | Den Besten | |
| 4,277,106 | A | 7/1981 | Sahley | |
| 4,439,250 | A | 3/1984 | Acharya | |
| 4,465,221 | A | 8/1984 | Schmidt | |
| 4,484,644 | A | 11/1984 | Cook | |
| 4,489,986 | A | 12/1984 | Dziak | |
| 4,627,665 | A * | 12/1986 | Ewing et al. | 299/113 |
| 4,678,237 | A | 7/1987 | Collin | |
| 4,682,987 | A | 7/1987 | Brady | |
| 4,688,856 | A | 8/1987 | Elfgen | |
| 4,725,098 | A | 2/1988 | Beach | |
| 4,729,603 | A | 3/1988 | Elfgen | |
| 4,765,686 | A | 8/1988 | Adams | |
| 4,765,687 | A | 8/1988 | Parrott | |
| 4,776,862 | A | 10/1988 | Wiand | |
| 4,880,154 | A | 11/1989 | Tank | |
| 4,911,503 | A | 3/1990 | Stiffler | |
| 4,911,504 | A | 3/1990 | Stiffler | |
| 4,932,723 | A | 6/1990 | Mills | |
| 4,940,288 | A | 7/1990 | Stiffler | |
| 4,941,711 | A | 7/1990 | Stiffler | |
| 4,944,559 | A | 7/1990 | Sionnet | |
| 4,951,762 | A | 8/1990 | Lundell | |
| 4,981,328 | A | 1/1991 | Stiffler | |
| 5,011,515 | A | 4/1991 | Frushour | |
| 5,112,165 | A * | 5/1992 | Hedlund et al. | 299/113 |
| 5,141,289 | A | 8/1992 | Stiffler | |
| 5,154,245 | A | 10/1992 | Waldenstrom | |
| 5,186,892 | A | 2/1993 | Pope | |
| 5,251,964 | A | 10/1993 | Ojanen | |
| 5,261,499 | A | 11/1993 | Grubb | |
| 5,332,348 | A | 7/1994 | Lemelson | |
| 5,417,475 | A | 5/1995 | Graham | |
| 5,447,208 | A | 9/1995 | Lund | |
| 5,535,839 | A | 7/1996 | Brady | |
| 5,542,993 | A | 8/1996 | Rabinkin | |
| 5,653,300 | A | 8/1997 | Lund | |
| 5,738,698 | A | 4/1998 | Kapoor | |
| 5,823,632 | A | 10/1998 | Burkett | |
| 5,837,071 | A | 11/1998 | Anderson | |
| 5,845,547 | A | 12/1998 | Sollami | |
| 5,875,862 | A | 3/1999 | Jurewicz | |
| 5,934,542 | A | 8/1999 | Nakamura | |
| 5,935,718 | A | 8/1999 | Demo | |
| 5,944,129 | A | 8/1999 | Jensen | |
| 5,967,250 | A | 10/1999 | Lund | |
| 5,992,405 | A | 11/1999 | Sollami | |
| 6,006,846 | A | 12/1999 | Tibbitts | |
| 6,019,434 | A | 2/2000 | Emmerich | |
| 6,044,920 | A | 4/2000 | Massa | |
| 6,051,079 | A | 4/2000 | Andersson | |
| 6,056,911 | A | 5/2000 | Griffin | |
| 6,065,552 | A | 5/2000 | Scott | |
| 6,113,195 | A | 9/2000 | Mercier | |
| 6,170,917 | B1 | 1/2001 | Heinrich | |
| 6,193,770 | B1 | 2/2001 | Sung | |
| 6,196,636 | B1 | 3/2001 | Mills | |
| 6,196,910 | B1 | 3/2001 | Johnson | |
| 6,199,956 | B1 | 3/2001 | Kammerer | |
| 6,216,805 | B1 | 4/2001 | Lays | |
| 6,270,165 | B1 | 8/2001 | Peay | |
| 6,341,823 | B1 | 1/2002 | Sollami | |
| 6,354,771 | B1 | 3/2002 | Bauschulte | |
| 6,364,420 | B1 | 4/2002 | Sollami | |
| 6,371,567 | B1 | 4/2002 | Sollami | |
| 6,375,272 | B1 | 4/2002 | Ojanen | |
| 6,419,278 | B1 | 7/2002 | Cunningham | |
| 6,478,383 | B1 | 11/2002 | Ojanen | |
| 6,499,547 | B2 | 12/2002 | Scott | |
| 6,517,902 | B2 | 2/2003 | Drake | |
| 6,554,369 | B2 * | 4/2003 | Sollami | 299/111 |
| 6,585,326 | B2 | 7/2003 | Sollami | |
| 6,685,273 | B1 | 2/2004 | Sollami | |
| 6,692,083 | B2 | 2/2004 | Latham | |
| 6,709,065 | B2 | 3/2004 | Peay | |
| 6,719,074 | B2 | 4/2004 | Tsuda | |
| 6,733,087 | B2 * | 5/2004 | Hall et al. | 299/113 |
| 6,739,327 | B2 | 5/2004 | Sollami | |
| 6,758,530 | B2 | 7/2004 | Sollami | |
| 6,786,557 | B2 | 9/2004 | Montgomery, Jr. | |
| 6,824,225 | B2 | 11/2004 | Stiffler | |
| 6,851,758 | B2 | 2/2005 | Beach | |
| 6,854,810 | B2 | 2/2005 | Montgomery, Jr. | |
| 6,861,137 | B2 | 3/2005 | Griffin | |
| 6,889,890 | B2 | 5/2005 | Yamazaki | |
| 6,966,611 | B1 | 11/2005 | Sollami | |
| 6,994,404 | B1 | 2/2006 | Sollami | |
| 7,204,560 | B2 | 4/2007 | Mercier | |
| 2002/0175555 | A1 | 11/2002 | Mercier | |
| 2003/0141350 | A1 | 7/2003 | Noro | |
| 2003/0209366 | A1 * | 11/2003 | McAlvain | 175/427 |
| 2003/0234280 | A1 | 12/2003 | Cadden | |
| 2004/0026983 | A1 | 2/2004 | McAlvain | |
| 2004/0065484 | A1 | 4/2004 | McAlvain | |
| 2005/0159840 | A1 | 7/2005 | Lin | |
| 2005/0173966 | A1 | 8/2005 | Mouthaan | |
| 2006/0237236 | A1 | 10/2006 | Sreshta | |

* cited by examiner

BRAZE THICKNESS CONTROL

CROSS REFERENCE TO RELATED APPLICATIONS

This application is a continuation of U.S. patent application Ser. No. 12/200,786, filed Aug. 28, 2008, which is a continuation-in-part of U.S. patent application Ser. No. 12/177,556, filed Jul. 22, 2008, now U.S. Pat. No. 7,635,168 which is a continuation-in-part of U.S. patent application Ser. No. 12/135,595, filed Jun. 9, 2008, which is a continuation-in-part of U.S. Pat. No. 12/112,743, filed Apr. 30, 2008, which is a continuation-in-part of U.S. patent application Ser. No. 12/051,738, filed Mar. 19, 2008, which is a continuation-in-part of U.S. patent application Ser. No. 12/051,689, filed Mar. 19, 2008, which is a continuation of U.S. patent application Ser. No. 12/051,586, filed Mar. 19, 2008, which is a continuation-in-part of U.S. patent application Ser. No. 12/021,051, filed Jan. 28, 2008, which is a continuation-in-part of U.S. patent application Ser. No. 12/021,019, filed Jan. 28, 2008, which was a continuation-in-part of U.S. patent application Ser. No. 11/971,965, filed Jan. 10, 2008, now U.S. Pat. No. 7,648,210 which is a continuation of U.S. patent application Ser. No. 11/947,644, filed Nov. 29, 2007, which was a continuation-in-part of U.S. patent application Ser. No. 11/844,586, filed Aug. 24, 2007, now U.S. Pat. No. 7,600,823, U.S. patent application Ser. No. 11/844,586 is a continuation-in-part of U.S. patent application Ser. No. 11/829,761, filed Jul. 27, 2007, U.S. patent application Ser. No. 11/829,761 is a continuation-in-part of U.S. patent application Ser. No. 11/773,271, filed Jul. 3, 2007, U.S. patent application Ser. No. 11/773,271 is a continuation-in-part of U.S. patent application Ser. No. 11/766,903, filed Jun. 22, 2007, U.S. patent application Ser. No. 11/766,903 is a continuation of U.S. patent application Ser. No. 11/766,865, filed Jun. 22, 2007, U.S. patent application Ser. No. 11/766,865 is a continuation-in-part of U.S. patent application Ser. No. 11/742,304, filed Apr. 30, 2007, now U.S. Pat. No. 7,475,948. U.S. patent application Ser. No. 11/742,304 is a continuation of U.S. patent application Ser. No. 11/742,261, filed Apr. 30, 2007, now U.S. Pat. No. 7,469,971. U.S. patent application Ser. No. 11/742,261 is a continuation-in-part of U.S. patent application Ser. No. 11/464,008, filed Aug. 11, 2006, now U.S. Pat. No. 7,338,135. U.S. patent application Ser. No. 11/464,008 is a continuation-in-part of U.S. patent application Ser. No. 11/463,998, filed Aug. 11, 2006, now U.S. Pat. No. 7,384,105. U.S. patent application Ser. No. 11/463,998 is a continuation-in-part of U.S. patent application Ser. No. 11/463,990, filed Aug. 11, 2006, now U.S. Pat. No. 7,320,505. U.S. patent application Ser. No. 11/463,990 is a continuation-in-part of U.S. patent application Ser. No. 11/463,975, filed Aug. 11, 2006, now U.S. Pat. No. 7,445,294. U.S. patent application Ser. No. 11/463,975 is a continuation-in-part of U.S. patent application Ser. No. 11/463,962, filed Aug. 11, 2006, now U.S. Pat. No. 7,413,256. U.S. patent application Ser. No. 11/463,962 is a continuation-in-part of U.S. patent application Ser. No. 11/463,953, filed Aug. 11, 2006, now U.S. Pat. No. 7,464,993. The present application is also a continuation-in-part of U.S. patent application Ser. No. 11/695,672, filed Apr. 3, 2007, now U.S. Pat. No. 7,396,086. U.S. patent application Ser. No. 11/695,672 is a continuation-in-part of U.S. patent application Ser. No. 11/686,831, filed Mar. 15, 2007, now U.S. Pat. No. 7,568,770. All of these applications are herein incorporated by reference for all that they contain.

BACKGROUND OF THE INVENTION

The present invention relates to a wear resistant tool for use in mining, milling and excavation. The tool comprises a body and a carbide secured to the tool body by brazing. It is especially related to a braze thickness at a braze joint between the cutting insert and the body of the tool.

U.S. Pat. No. 5,141,289 which is incorporated by reference for all that it contains, discloses an improved cemented carbide tip is provided for use as the forward end of a cutter bit. The tip is rotationally symmetric about its longitudinal axis and has a rearward end for attachment to a ferrous metal body. The rearward end has an annular rearwardly facing first surface, a second surface located radially inside of and forward of the first surface, and a radially inwardly facing third surface separating the first surface from the second surface, and thereby forming a socket in the rear of the tip. The tip further includes a means for substantially centering the tip about a steel protrusion which is to be brazed into the socket. The means for centering preferably takes the form of bumps extending radially inwardly from the third surface of the tip.

Examples of wear resistant tools from the prior art are disclosed in U.S. Pat. No. 4,941,711 to Stiffler, U.S. Pat. No. 4,893,875 to Lonn et al., U.S. Pat. No. 4,201,421 to Den Besten et al., U.S. Pat. No. 4,547,020 to Ojanen, U.S. Pat. No. 4,216,832 to Stephenson et al., U.S. Pat. No. 3,519,309 to Engle et al., U.S. Pat. No. 2,707,619 to Andersson, U.S. Pat. No. 2,614,813 to Shepherd, which are all herein incorporated by reference for all they contain.

BRIEF SUMMARY OF THE INVENTION

In one aspect of the present invention, a degradation assembly comprises an inverted conical face formed in a top end of a metal body tapering towards a central axis of the metal body. A base end of a carbide bolster is adapted to be brazed to the top end of the metal body within the inverted conical face. At least one protrusion is formed in the inverted conical face and is adapted to control a braze thickness between the face and the base end.

An impact tip may be bonded to the carbide bolster. The tip may comprise a super hard material bonded to a cemented metal carbide substrate at a non-planar interface. The super hard material may comprise substantially conical geometry with a rounded apex. The impact tip may comprise a diameter larger than a diameter of the carbide bolster to which it is bonded. The conical face may taper towards the central axis of the metal body at a declined angle of 20-30 degrees. The top end of the metal body may comprise a bore centered on the central axis and adapted to receive a stem formed in the base end of the carbide bolster. The stem may comprise an outer wall tapering at less than four degrees.

A braze material disposed intermediate the face and the base end may comprise a non-uniform thickness. The protrusion may comprise an annular ridge, a segmented ridge, a circular bump, a sinuous bump, or combinations thereof. The protrusion may comprise at least three equally spaced bumps. The top end of the metal body may comprise a diameter greater than a diameter of the base end of the carbide bolster. In some embodiments, the degradation assembly may be incorporated in drill bits, shear bits, milling machines, indenters, mining degradation assemblies, asphalt degradation assemblies, asphalt bits, trenching machines, fixed cutter drill bits, horizontal drill bits, percussion drill bits, roller cone bits, mining picks, pavement milling picks, trencher picks, auger picks, or combinations thereof.

A plurality of protrusions formed in the inverted conical face may be arranged in at least two annular rows and the two rows may be offset from each other. The protrusions formed in at least one row may be generally shorter than the protrusions in the other row. The protrusions may be less than 0.007 inches. The carbide bolster may comprise a cavity formed in its base end. The inverted conical face may comprise an annular lip protruding into the cavity of the bolster. The lip may comprise a curve facing an annular transition between the base end of the bolster and its cavity. The braze thickness may be increased at the transition. The metal body may be a rotatable shield fitted over a rotary bearing surface.

In another aspect of the invention a degradation assembly has a base end of the carbide bolster brazed to a steel body on an annular, tapered face and the base end and the face being separated by a pre-determined distance. A peripheral annular lip circumscribes the face. The bolster comprising an outer diameter adapted to be received within the annulus of the annular lip and the bolster also comprising a first transition between the base end and the outer diameter and a second transition joins the face and the lip in the proximity of first transition. Space between the bolster and steel body is filled with a braze material and the distance between the transitions is greater than the pre-determined distance.

The degradation assemblies may be incorporated into fixed cutter drill bit, horizontal drill bit, percussion drill bit, roller cone bit, mining pick, pavement milling pick, trencher pick, auger pick, or combinations thereof.

DETAILED DESCRIPTION OF THE INVENTION AND THE PREFERRED EMBODIMENT

Figure 1:
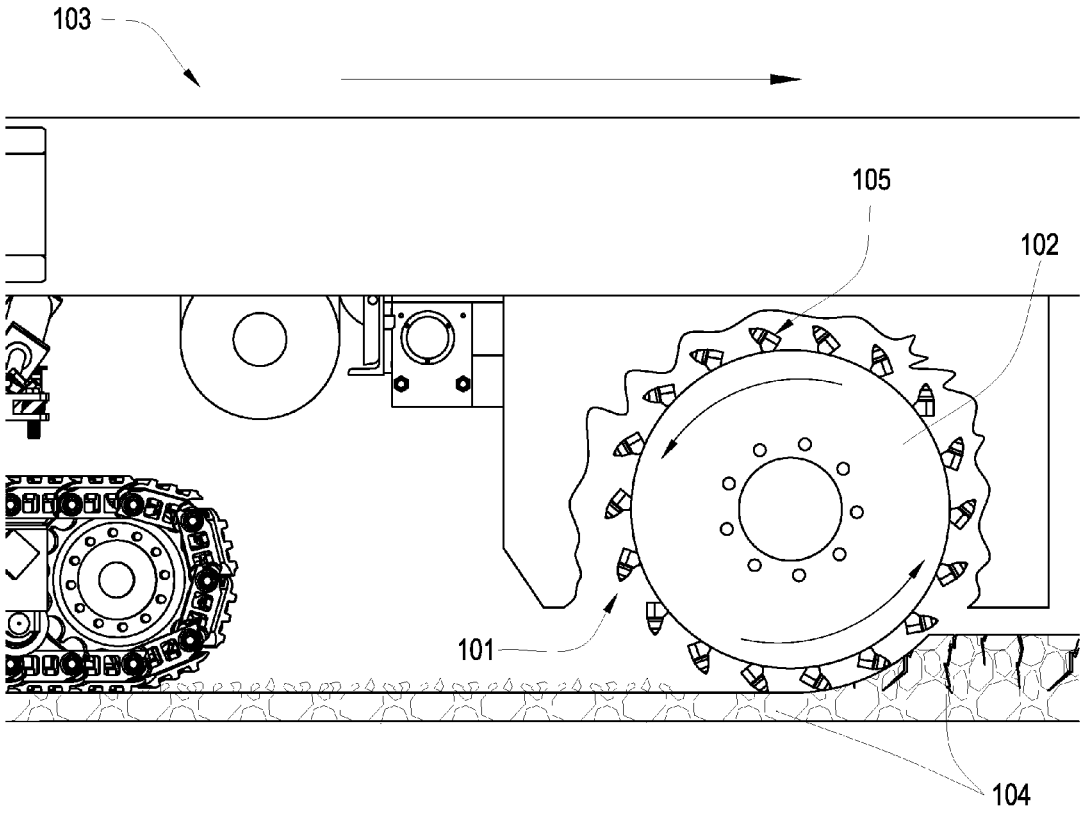
FIG. 1 is a cross-sectional diagram of an embodiment of a plurality of degradation assemblies suspended underside of a pavement milling machine.

FIG. 1 is a cross-sectional diagram that shows a plurality of degradation assemblies 101 attached to a driving mechanism 102, such as a rotatable drum attached to the underside of a pavement milling machine 103. The milling machine 103 may be an asphalt or pavement planer used to degrade man-made formations such as pavement 104 prior to placement of a new layer of pavement. The degradation assemblies 101 may be attached to the drum 102, bringing the degradation assemblies 101 into engagement with the formation 104. A holder 105, such as a block welded or bolted to the drum, is attached to the driving mechanism 102 and the degradation assembly is inserted into the holder. The holder 105 may hold the degradation assembly 101 at an angle offset from the direction of rotation, such that the degradation assembly engages the formation 104 at a preferential angle. In some embodiments, shanks of the degradations assemblies are rotatably disposed within the holders.

Figure 2:
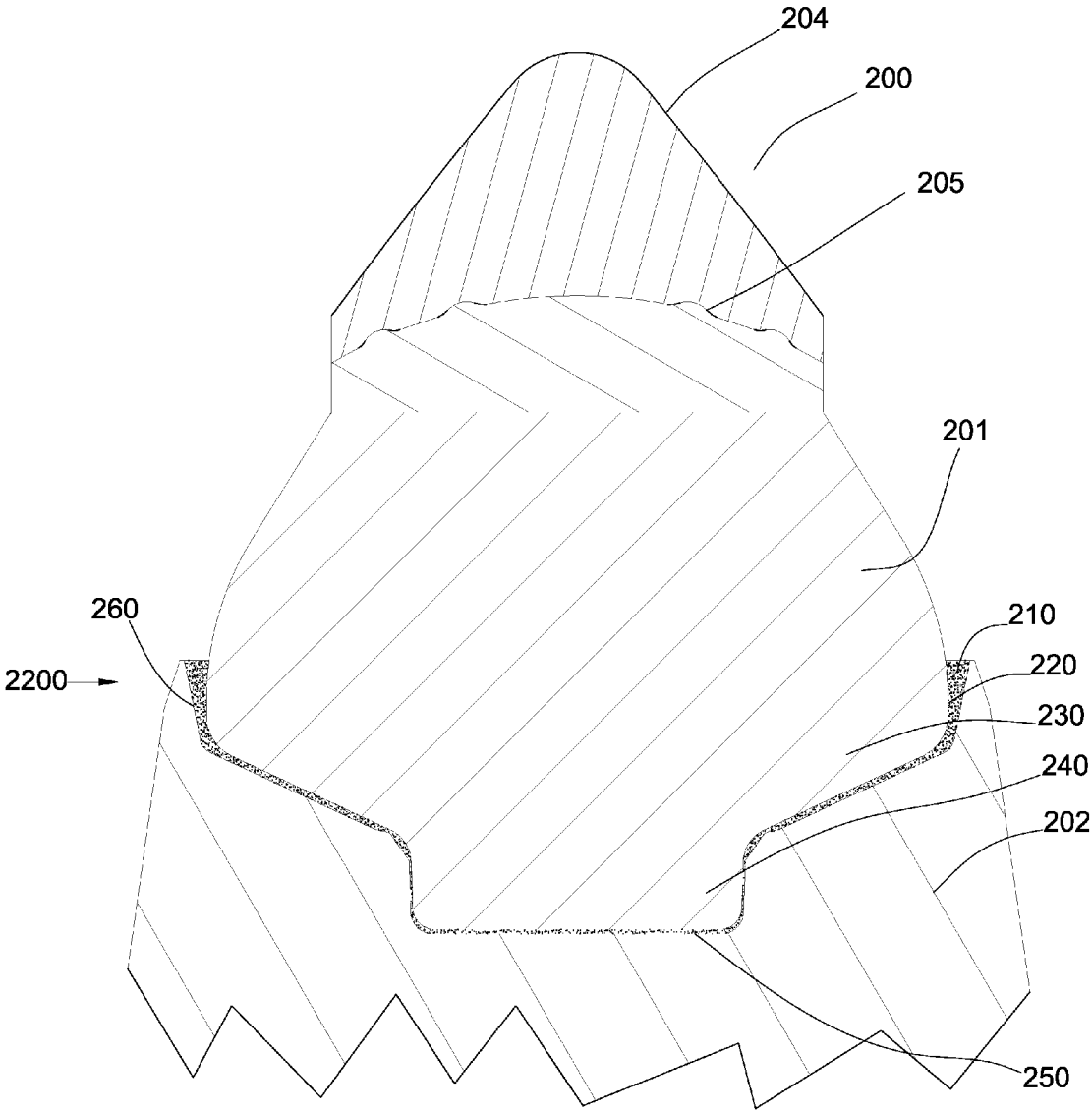
FIG. 2 is a cross-sectional diagram of an embodiment of a degradation assembly.

Referring to FIG. 2, the degradation assembly comprises an impact tip 200, a carbide bolster 201 and a metal body 202. The impact tip 200 may comprise a super hard material 204 bonded to cemented metal carbide 201 at a non-planar interface 205. The super hard material 204 may comprise a material selected from a group comprising diamond, polycrystalline diamond, natural diamond, synthetic diamond, vapor deposited diamond, silicon bonded diamond, cobalt bonded diamond, thermally stable diamond, polycrystalline diamond with a binder concentration of 1 to 40 weight percent, infiltrated diamond, layered diamond, monolithic diamond, polished diamond, course diamond, fine diamond, cubic boron nitride, diamond impregnated matrix, diamond impregnated carbide, metal catalyzed diamond, or combinations thereof. The super hard material 204 may comprise substantially conical geometry with a rounded apex. In some embodiments, the superhard material comprises a thickness of greater than 0.100 inch. In some embodiment of the invention, the superhard material comprises a larger volume than the substrate that it is attached to.

The bolster 201 and the metal body 202 are bonded together by brazing. The braze material 210 may comprise silver, gold, copper, nickel, palladium, boron, chromium, silicon, germanium, aluminum, iron, cobalt, manganese, titanium, tin, gallium, vanadium, indium, phosphorus, molybdenum, platinum, zinc, or combinations thereof. The metal body 202 may comprise steel, chromium, tungsten, tantalum, niobium, titanium, molybdenum, carbide, natural diamond, diamond impregnated matrix, silicon bonded diamond, and combinations thereof.

The impact tip 200 may comprise a diameter larger than a diameter of the carbide bolster 201 to which it is bonded. The base end 230 of the carbide bolster 201 may comprise a stem 240 adapted to fit into a bore 250 of the metal body 202. The stem 240 may resist the shear force developed at a periphery of the top end 260 of the metal body 202. The stem 240 may comprise an outer wall tapering at less than four degrees. The top end 260 of the metal body 202 may comprise a diameter greater than a diameter of the base end 230 of the carbide bolster 201. The largest diameter of the carbide bolster 201 may remain secured inside the metal body 202. The base end of the bolster may be tapered between 50 and 30 degrees and help buttress the bolster upon impact.

It is believed that by controlling the thickness of the braze material to a predetermined distance, the stresses between the carbide and steel may also be controlled. Milling, mining, trenching and other applications where the degradation assemblies may be used are often subjected to high impact loads which propagate through the entire assembly. It is believed that propagating stress from the relatively stiff carbide to softer steel at the periphery of the joint may require a larger transition, which may be accomplished through a thicker braze material towards the periphery than the majority of the joint. The thinner portions of the braze joint also comprise optimal parameters which the protrusions may help control. The angle of the base end of the carbide and the angle of the inverted face of the body may be substantially the same or they may be different in order to increase or decrease the thickness of the braze material towards the periphery.

The bolster and the face by be separated by a predetermined distance as established by the protrusions. The peripheral annular lip 2200 may circumscribe the face. An outer diameter of the bolster may be received with an annulus formed by the lip. A first transition may be formed between the largest outer diameter of the bolster and its base end and a second transition may be formed between the lip and the inverted face. The space between the bolster and the steel body may be filled with the braze material. The distance between the transitions may be greater than the pre-determined distance. In some embodiments, the largest diameter of the bolster is below the top 260 of the lip. The lip may comprise a triangular cross-section. The distance between the bolster and lip may increase approaching the top of the lip.

Figure 3:
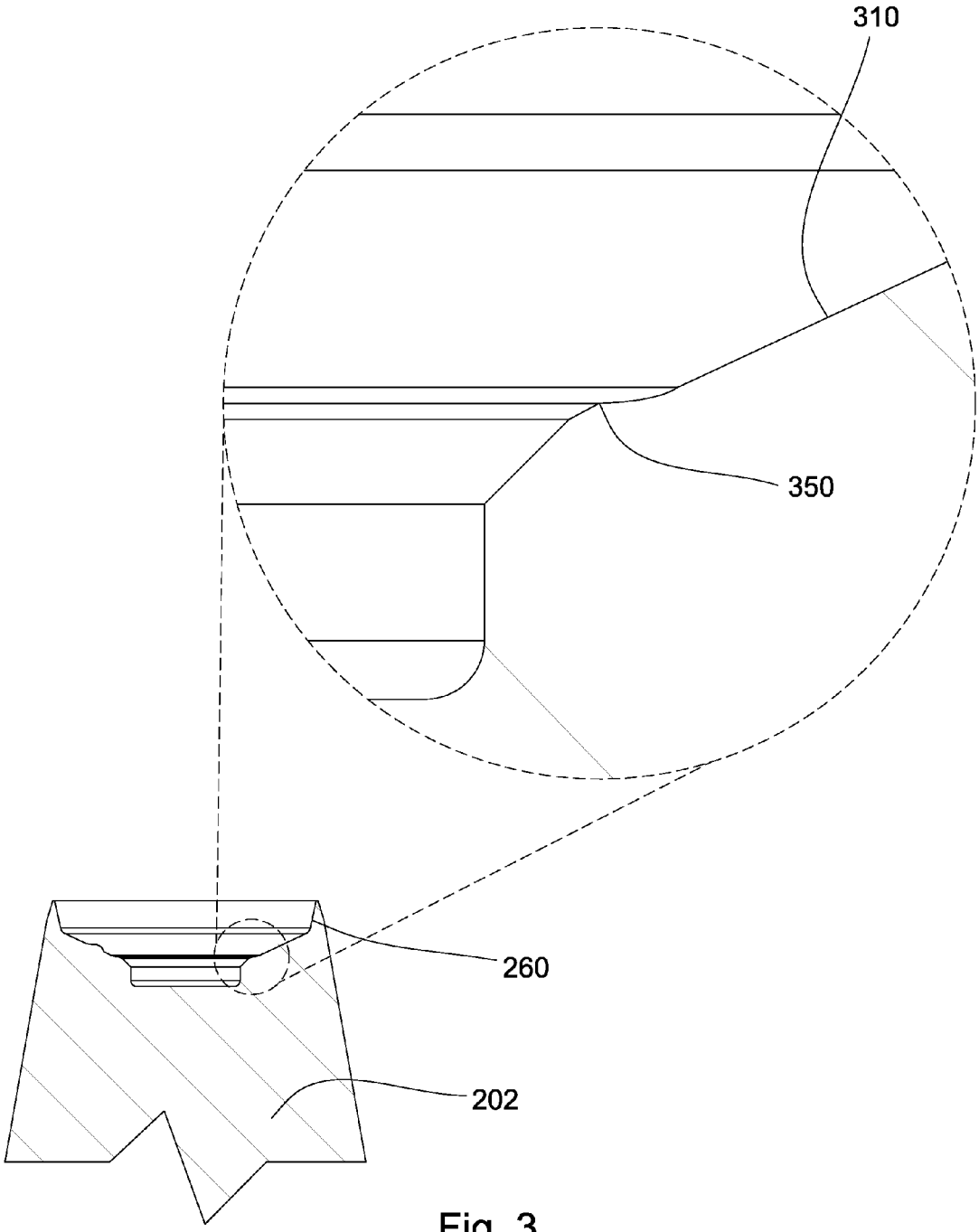
FIG. 3 is a cross-sectional diagram of an embodiment of a body of a degradation assembly.

FIG. 3 is a cross-sectional diagram of an embodiment of a body 202 of a degradation assembly 101. A top end 260 of the body 202 comprises an inverted conical face 310 tapering towards the central axis of the metal body 202. The conical face 310 may be tapered at a declined angle of 20-30 degrees. A preferred angle of declination is 25 degrees. A protrusion 350 is formed on the surface of the conical face 310. The protrusion 350 may comprise a height of 0.002 to 0.007 inches.

Figure 4:
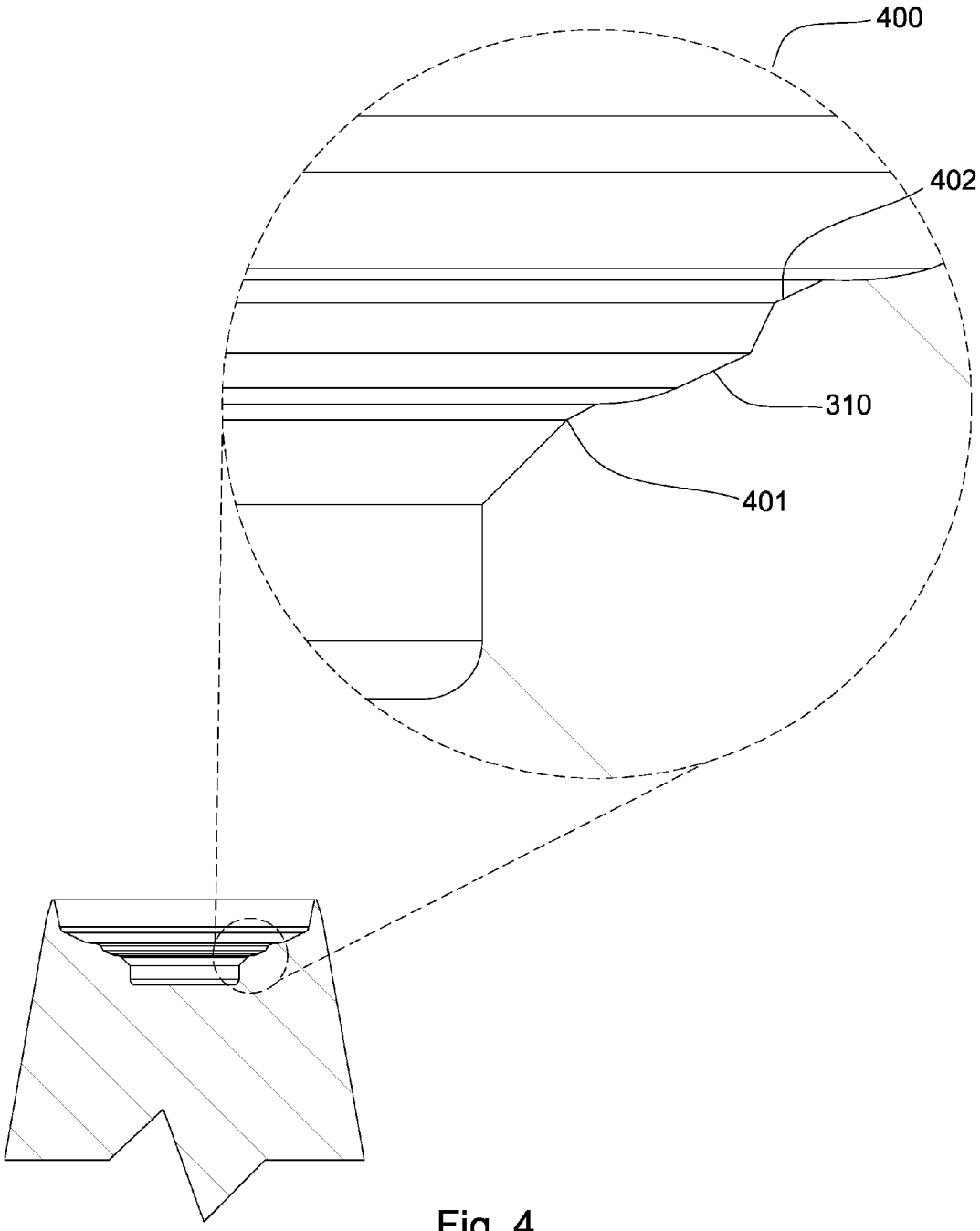
FIG. 4 is a cross-sectional diagram of another embodiment of a body of a degradation assembly.

FIG. 4 is a cross-sectional diagram of another embodiment of a degradation assembly 101. The conical face 310 of the metal body 202 may comprise a double protrusion 400. The double protrusion may comprise a first ridge 401 and a second ridge 402. The second ridge 402 may lie just above the first ridge 401. The double ridge 400 may provide an additional support to control the braze thickness. The first ridge 401 and the second ridge 402 may comprise different heights.

Figure 5:
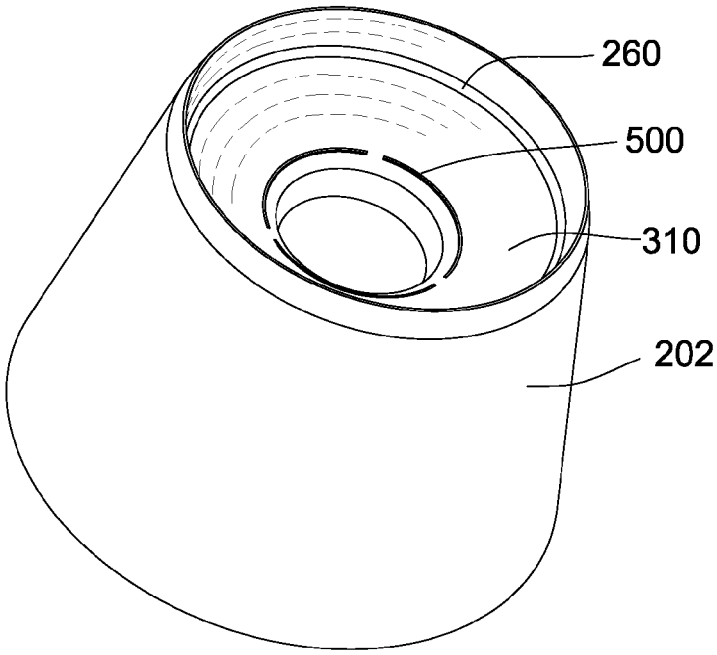
FIG. 5 is a perspective diagram of another embodiment of a body of a degradation assembly.

FIG. 5 is a perspective diagram of an embodiment of a body 202 of a degradation assembly 101. The conical face 310 of the metal body 202 may comprise mother embodiment of a protrusion in the form of arcuate ridges 500. The arcuate ridges 500 may comprise at least three equally spaced segments. The ridges 500 may control the flow of the braze material and a gap between the top end 260 of the metal body 202 and the base end 230 of the carbide bolster 201 while they are being brazed together.

Figure 6:
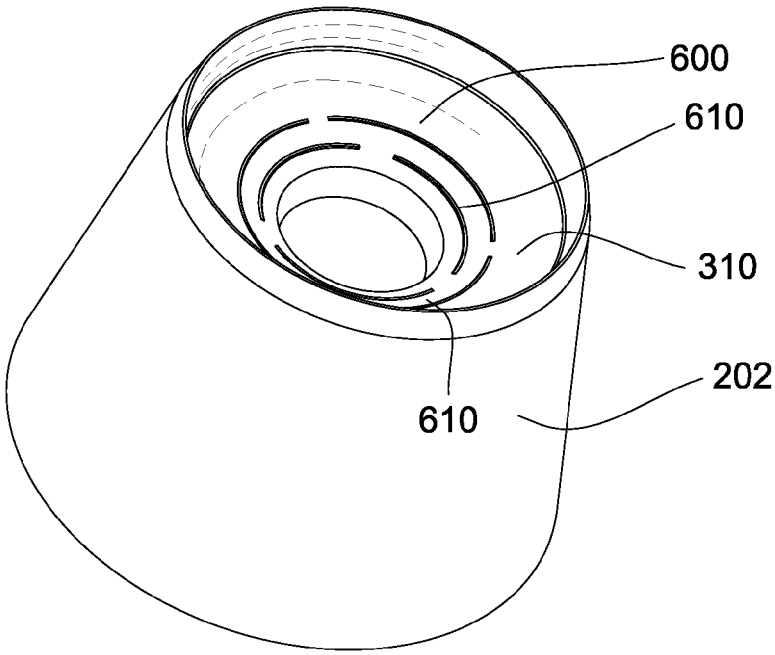
FIG. 6 is a perspective diagram of another embodiment of a body of a degradation assembly.

FIG. 6 is a perspective diagram of another embodiment of a body 202 of a degradation assembly 101. The conical face 310 of the metal body 202 may comprise double arcuate ridges 600. Each ridge may be equally spaced. The ridges 600 may comprise over lapping segments 610. The ridges 600 are offset from each other and may comprise different heights.

Figure 7:
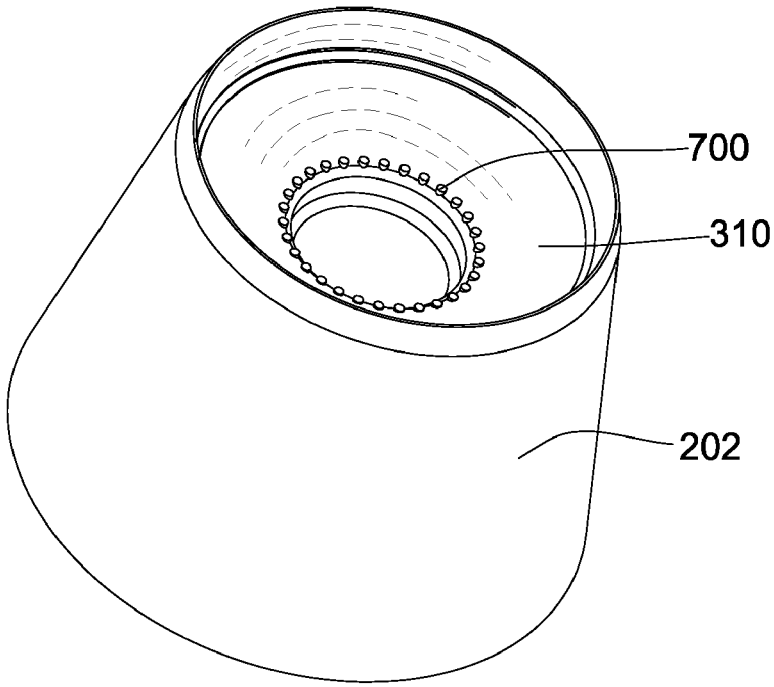
FIG. 7 is a perspective diagram of another embodiment of a body of a degradation assembly.

FIG. 7 is a perspective diagram of another embodiment of a body 202 of a degradation assembly 101. The conical face 310 of the metal body 202 may comprise a row of circular bumps 700. The spherical shape bumps 700 may comprise a height of 0.002-0.007 inches.

Figure 8:
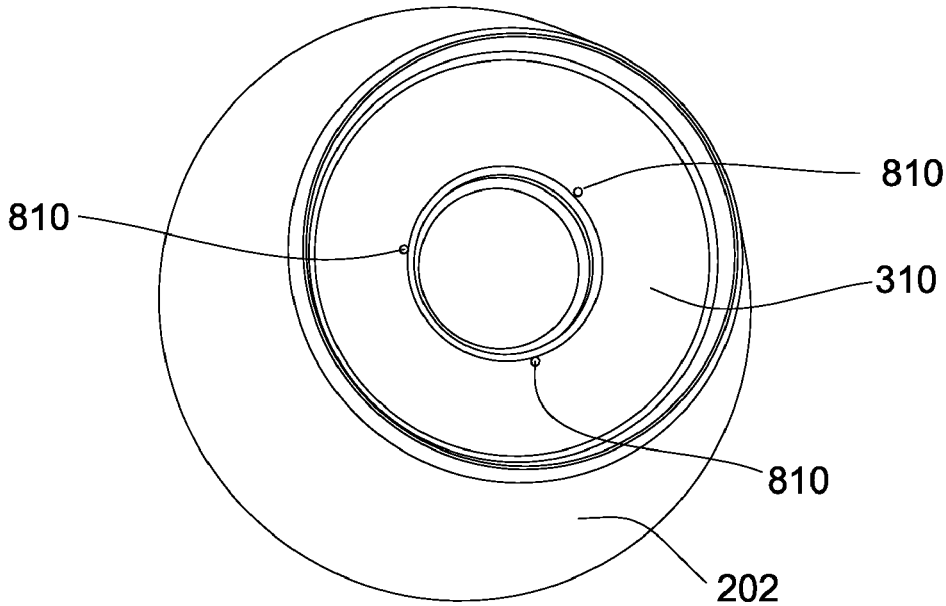
FIG. 8 is a perspective diagram of another embodiment of a body of a degradation assembly.

FIG. 8 is discloses a body 202 of a degradation assembly 101. The conical face 310 of the metal body 202 may comprise at least three equally spaced bumps 810 located at 120 degrees to each other.

Figure 9:
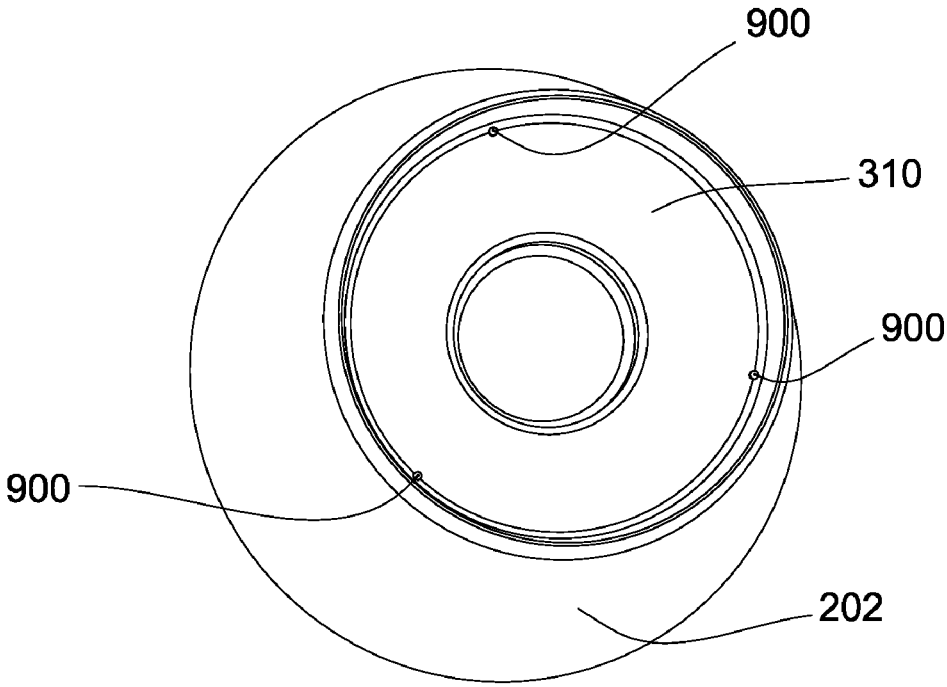
FIG. 9 is a perspective diagram of another embodiment of a body of a degradation assembly.

FIG. 9 discloses a body 202 of a degradation assembly 101. The conical face 310 of the metal body 202 may comprise three equally spaced bumps 900 near the periphery of the body 202.

Figure 10:
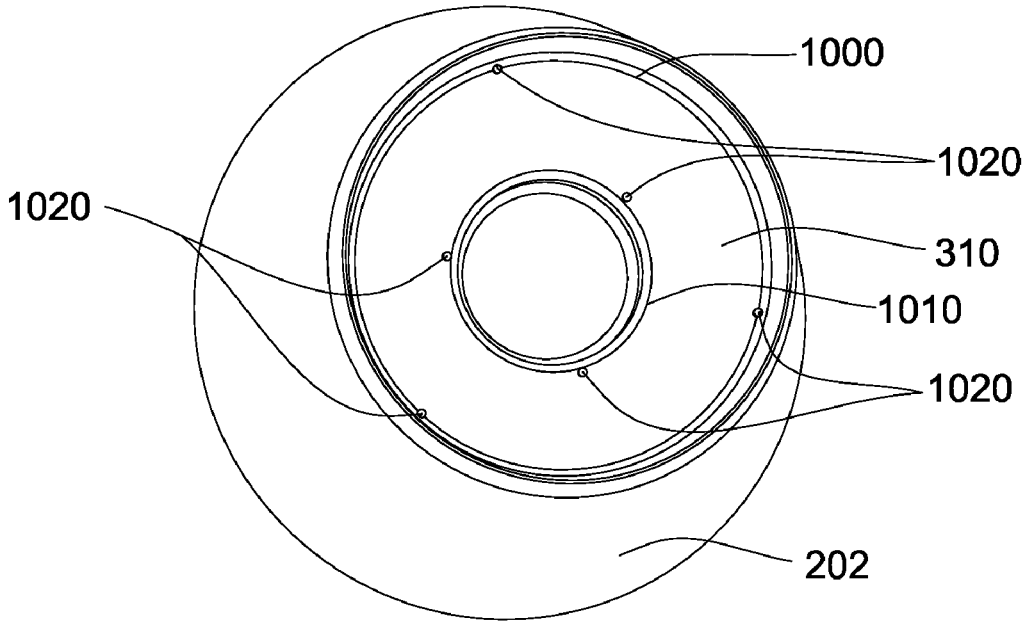
FIG. 10 is a perspective diagram of another embodiment of a body of a degradation assembly.

FIG. 10 is a perspective diagram of another embodiment of a body 202 of a degradation assembly 101. The conical face 310 of the metal body 202 may comprise two annular rows 1000, 1010 of circular bumps 1020 to control the braze joint thickness. Each row may comprise at least three equally spaced bumps 1020. The bumps 1020 in the rows 1000, 1010 may comprise an alternating configuration.

Figure 11:
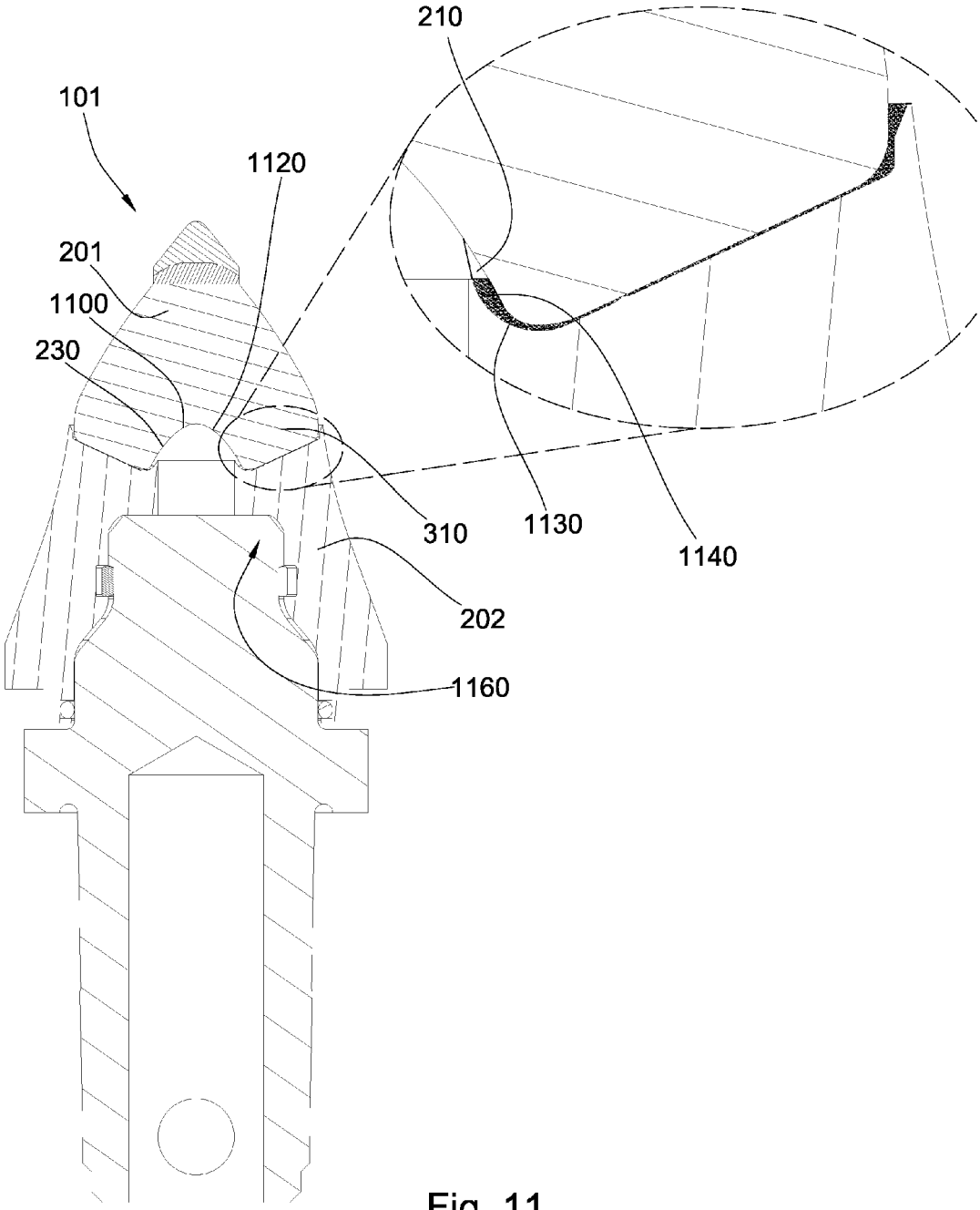
FIG. 11 is a cross-sectional diagram of another embodiment of a body of a degradation assembly.

FIG. 11 is a cross-sectional diagram of an embodiment of a degradation assembly 101. The degradation assembly 101 may comprise a cavity 1100 formed in the base end 230 of the carbide bolster 201. The conical face 310 may comprise a medial annular lip 1120 protruding into the cavity 1100 of the bolster 201. The lip 1120 may help prevent braze entering a rotary bearing 1160 while brazing. A third transition 1130 may exist between the face and the medial lip which faces a fourth transition 1140 between the base end 230 of the bolster 201 and its cavity 1100. The distance between the third and fourth transitions may be greater than the pre-determined distance. The braze thickness may increase at a transition 1140 for stress reduction. All corners preferably have radiuses. The braze material 210 may not reach to a top end of the lip 1120. The metal body 202 may rotate over a rotary bearing surface. All of the transitions may comprise radiuses.

Figure 12:
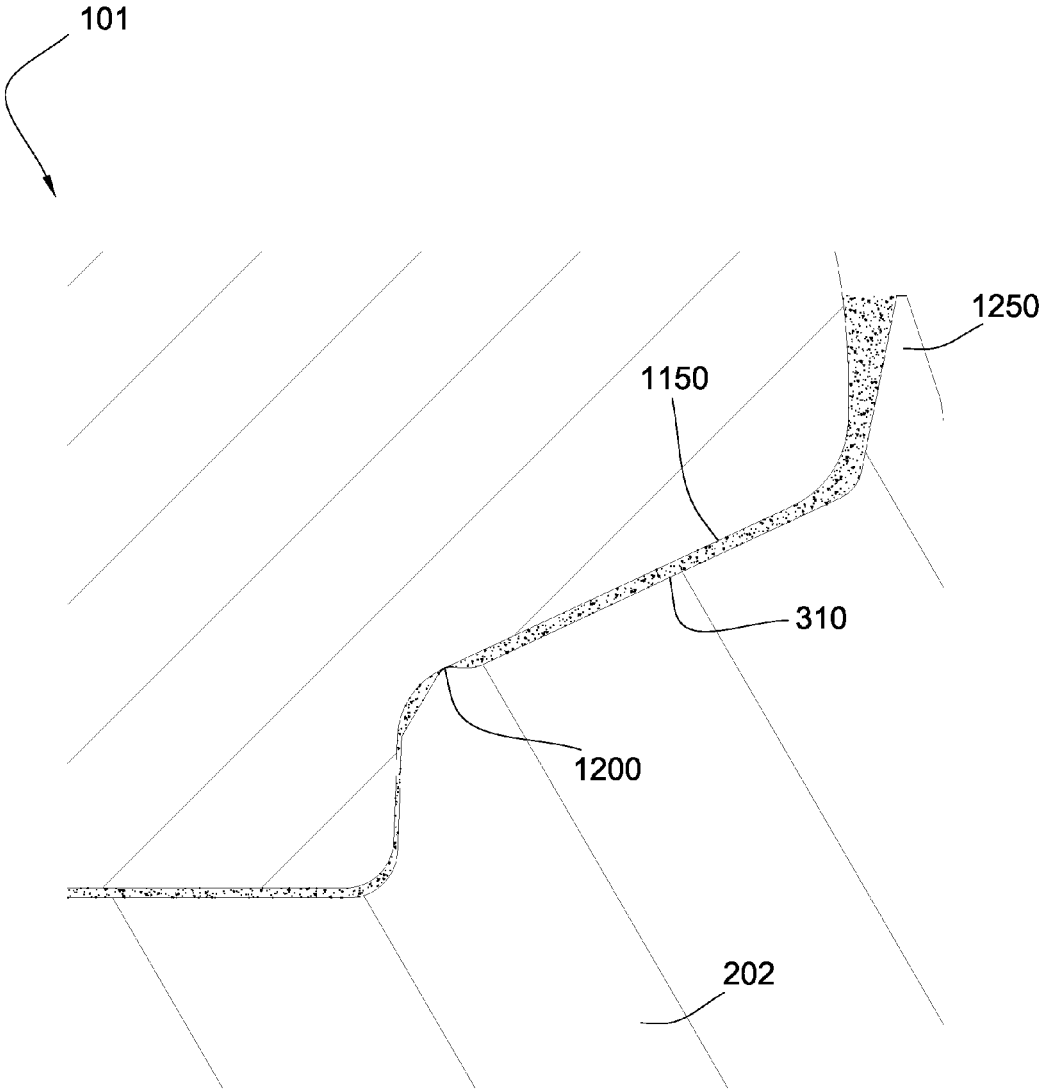
FIG. 12 is a cross-sectional diagram of an embodiment of a degradation assembly.

FIG. 12 discloses the inverted conical face 310 of the metal body 202 with a protrusion 1200. The protrusion 1200 is believed to control the braze thickness 1150. The brazed joint may comprise non-uniform thicknesses. The braze thickness 1150 may increase towards the periphery of the body 202. The braze thickness 1150 may be general thinner near the central axis of the body 202 and largest near the periphery of the body 202. The larger braze thickness near the periphery of the metal body 202 may provide a thicker transition between the relatively stiffer carbide and the more elastic steel of the body and thereby reducing stress between during brazing and protecting the thin steel edge 1250.

Figure 13:
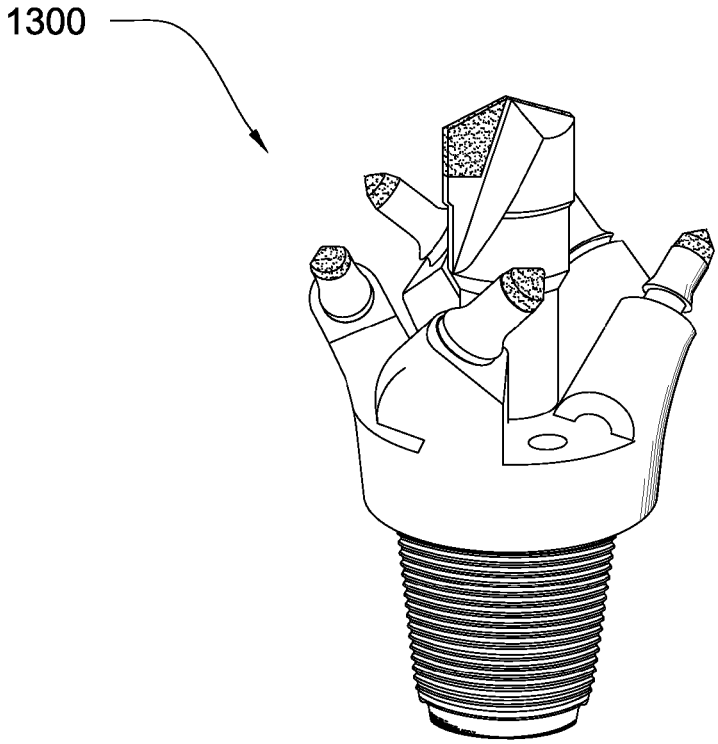
FIG. 13 is a cross-sectional diagram of an embodiment of a drill bit.
Figure 14:
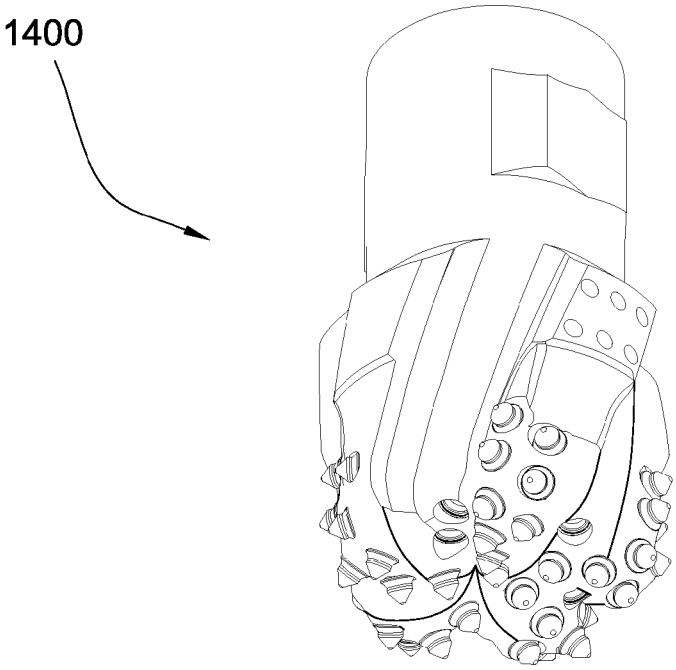
FIG. 14 is a perspective diagram of another embodiment of a drill bit.
Figure 15:
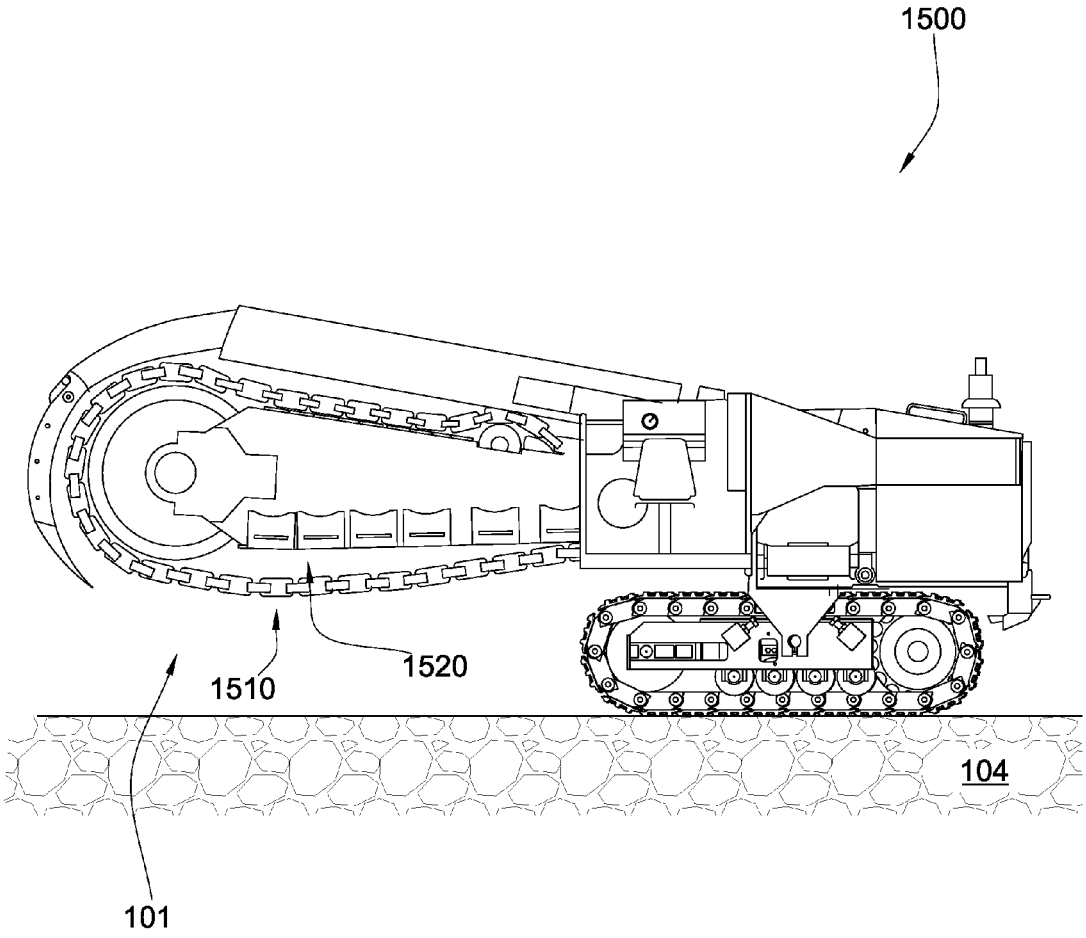
FIG. 15 is an orthogonal diagram of an embodiment of a trenching machine.

FIGS. 13-16 disclose various wear applications that may be incorporated with the present invention The present invention may be incorporated in drill bits, shear bits, milling machines, indenters, mining degradation assemblies, asphalt bits, asphalt degradation assemblies, trenching machines, or combinations thereof FIG. 13 discloses a drill bit 1300 typically used in water well drilling. The drill bit 1400 disclosed in FIG. 14 may be incorporated with the present invention. FIG. 15 is a perspective diagram of an embodiment of a chain trenching machine 1500. The degradation assemblies 101 may be placed on a chain 1510 that rotates around an arm 1520 of a chain trenching machine 1500.

Figure 16:
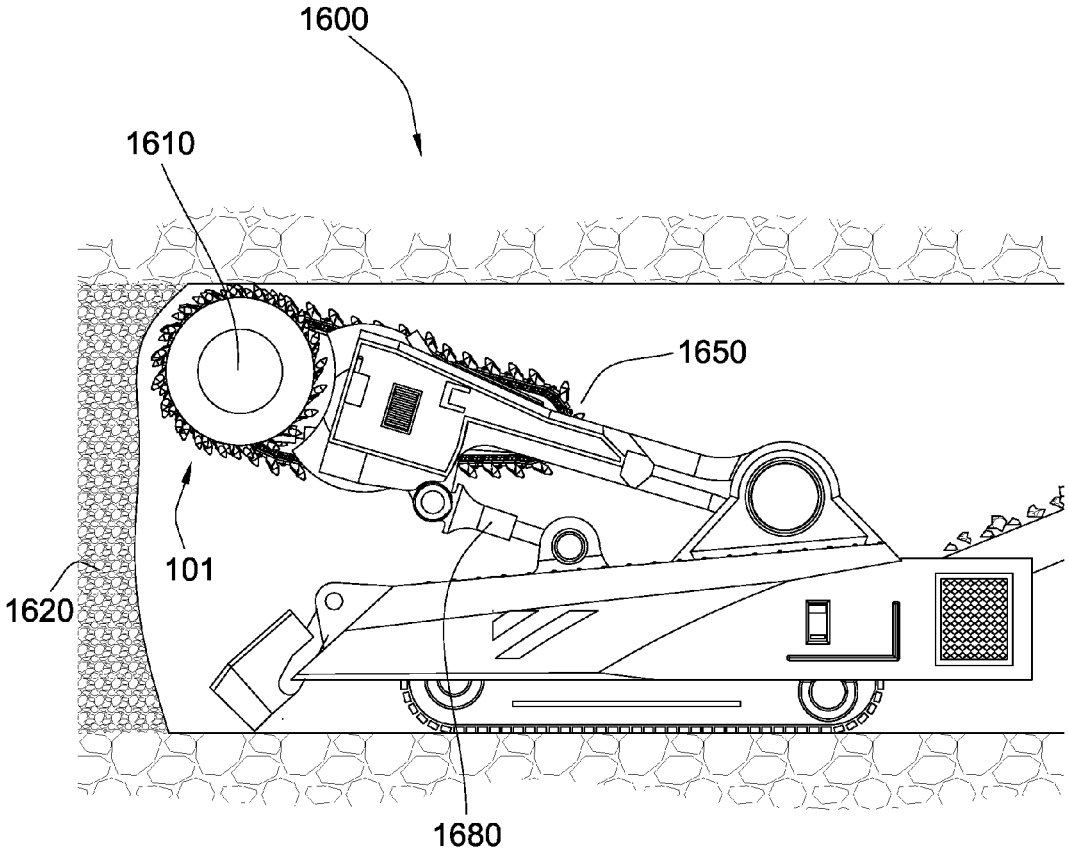
FIG. 16 is an orthogonal diagram of an embodiment of a coal excavator.

FIG. 16 is an orthogonal diagram of an embodiment of a coal excavator 1600. The degradation assemblies 101 may be connected to a rotating drum 1610 that is degrading the coal 1620. The rotating drum 1610 is connected to an arm 1650 that moves the drum 1610 vertically in order to engage the coal 1620. The arm 1650 may move by a hydraulic arm 1680, it may also pivot about an axis or a combination thereof. The coal excavator 1600 may move about by tracks, wheels, or a combination thereof The coal excavator 1600 may also move about in a subterranean formation. The coal trencher 1600 may be in a rectangular shape providing for easy mobility about the formation.

Whereas the present invention has been described in particular relation to the drawings attached hereto, it should be understood that other and further modifications apart from those shown or suggested herein, may be made within the scope and spirit of the present invention.

What is claimed is:

1. A degradation assembly, comprising:

a base end of a carbide bolster brazed to a steel body on an annular, tapered face; the base end and the face being separated by a pre-determined distance;

a peripheral annular lip circumscribes the face;

the bolster comprising an outer diameter adapted to be received within the annulus of the annular lip and the bolster also comprising a first transition between the base end and the outer diameter; and a second transition joins the face and the lip in the proximity of first transition;

the face comprises a medial annular lip with a third transition;

the base end of the bolster comprises a central cavity with a fourth transition, the medial annular lip protruding into the cavity;

wherein space between the bolster and steel body is filled with a braze material and the distance between the transitions is greater than the pre-determined distance.

2. The assembly of claim 1, wherein the first transition comprises a radius.

3. The assembly of claim 1, wherein the second transition comprises a radius.

4. The assembly of claim 1, wherein a largest outer diameter of the bolster is below a top of the lip.

5. The assembly of claim 1, wherein the lip comprises a triangular cross-section.

6. The assembly of claim 1, wherein the distance between the third and fourth transitions is greater than the pre-determined distance.

7. The assembly of claim 1, wherein base end of the bolster comprises a stem inserted into a bore formed in the steel body.

8. The assembly of claim 1, wherein the degradation assembly is incorporated in a fixed cutter drill bit, horizontal drill bit, percussion drill bit, roller cone bit, or combinations thereof.

9. The assembly of claim 1, wherein the degradation assembly is incorporated in a mining pick, pavement milling pick, trencher pick, auger pick, or combinations thereof.

10. The assembly of claim 1, wherein the steel body comprises an integral shank extending from the body adapted for rotatably connection within a holder.

11. The assembly of claim 1, wherein the steel body is a rotatable shield adapted for to rotate about a protrusions connection to a driving mechanism.

12. The assembly of claim 1, wherein the distance from the lip to the bolster increases approaching a top of the lip.

13. The assembly of claim 1, wherein a protrusion formed in the base end or the face controls the pre-determined distance.

14. The assembly of claim 1, wherein the conical face tapers towards the central axis of the metal body at a declined angle of 20-30 degrees.

* * * * *

UNITED STATES PATENT AND TRADEMARK OFFICE

CERTIFICATE OF CORRECTION

PATENT NO. : 7,661,765 B2
APPLICATION NO. : 12/200810
DATED : February 16, 2010
INVENTOR(S) : David R. Hall et al.

It is certified that error appears in the above-identified patent and that said Letters Patent is hereby corrected as shown below:

On the Title Page, Item (56)

Page 2, left column, line 4, under "U.S. PATENT DOCUMENTS", replace "3,745,396" with --3,746,396--.

In the Claims

In column 8, claim 11, line 19, after "shield adapted" delete "for".

Signed and Sealed this
Eighth Day of May, 2012

David J. Kappos

David J. Kappos
*Director of the United States Patent and Trademark Office*